US009021965B1

(12) United States Patent
Baird

(10) Patent No.: US 9,021,965 B1
(45) Date of Patent: May 5, 2015

(54) LASER DEFENSE GUN PORTS

(71) Applicant: Adam D. Baird, Salisbury, NC (US)

(72) Inventor: Adam D. Baird, Salisbury, NC (US)

(73) Assignee: Kontek Industries, Inc., Kannapolis, NC (US)

( * ) Notice: Subject to any disclaimer, the term of this patent is extended or adjusted under 35 U.S.C. 154(b) by 1 day.

(21) Appl. No.: 13/864,238

(22) Filed: Apr. 16, 2013

(51) Int. Cl.
*F41H 5/26* (2006.01)

(52) U.S. Cl.
CPC ..... *F41H 5/26* (2013.01)

(58) Field of Classification Search
CPC ..... E06B 7/30; E06B 7/28; F41H 5/26
USPC ..... 109/58.5, 21.5; 434/22, 21; 89/36.14, 89/36.04, 37.04, 30; 296/155; 42/107; 174/65 G
See application file for complete search history.

(56) References Cited

U.S. PATENT DOCUMENTS

| | | | | | |
|---|---|---|---|---|---|
| 1,847,419 | A | * | 3/1932 | Wise | 109/58.5 |
| 1,900,364 | A | * | 3/1933 | Popp | 109/58.5 |
| 1,911,408 | A | * | 5/1933 | Toney | 109/21.5 |
| 2,897,888 | A | | 5/1956 | Dragonuk | |
| 3,262,227 | A | | 7/1966 | Pentacost | |
| 3,559,528 | A | | 2/1971 | Cunningham | |
| 4,132,446 | A | | 1/1979 | Bauer et al. | |
| 4,316,404 | A | | 2/1982 | Medlin | |
| 4,352,316 | A | | 10/1982 | Medlin | |
| 4,624,641 | A | * | 11/1986 | Gallagher | 434/21 |
| 4,771,672 | A | | 9/1988 | Miller | |
| 4,771,673 | A | | 9/1988 | Miller | |
| 5,307,725 | A | | 5/1994 | Desmond et al. | |
| 6,278,061 | B1 | * | 8/2001 | Daoud | 174/659 |
| 6,425,311 | B1 | | 7/2002 | Caron | |
| RE38,096 | E | * | 4/2003 | Branthwaite et al. | 124/44.5 |
| 6,595,946 | B1 | * | 7/2003 | Pasqualucci | 604/27 |
| 6,935,864 | B2 | * | 8/2005 | Shechter et al. | 434/19 |
| 8,038,025 | B2 | * | 10/2011 | Stark et al. | 220/254.3 |
| 8,065,948 | B1 | | 11/2011 | Baptista et al. | |
| 8,438,964 | B1 | | 5/2013 | Nolte et al. | |

(Continued)

OTHER PUBLICATIONS npl: https://web.archive.org/web/20120611002711/http://www.rackmountsolutions.net/hotlok-round-4-rack-mount-grommet.asp Jun. 11, 2012.*

Pending U.S. Appl. No. 13/153,424, filed Jun. 5, 2011 and titled "Gun Ports", by Roger Allen Nolte and Greg Groening.

(Continued)

*Primary Examiner* — Samir Abdosh
*Assistant Examiner* — John D Cooper
(74) *Attorney, Agent, or Firm* — Barclay J. Tullis

(57) ABSTRACT

Gun ports fitted to a wall of a building or vehicle each comprise an expandable aperture that accommodates penetration from within by a gun barrel having irregularly shaped attachments. The gun ports can provide protection against laser pointers used in training exercises, where lasers are used outside the gun ports by attackers against those protected behind the gun ports. Each implementation of a gun port can accommodate guns of different sizes and shapes. The gun ports can be configured as exchangeable cartridges or subassemblies that can readily replace regular non-expandable apertures otherwise used for defense against real ballistic weapons and explosives. Each expandable aperture expands and contracts as necessary to fit sizes and shapes of a gun barrel portion inserted through it. Of special importance is accommodation of a laser sensor module attached near the firing end of a gun. A window for sighting the gun is provided.

21 Claims, 7 Drawing Sheets

(56) References Cited

U.S. PATENT DOCUMENTS

| | | | | |
|---|---|---|---|---|
| 2003/0079897 | A1* | 5/2003 | Sempliner et al. | 174/65 G |
| 2003/0082501 | A1* | 5/2003 | Varshneya | 434/22 |
| 2008/0003543 | A1* | 1/2008 | Varshneya | 434/21 |
| 2009/0120820 | A1* | 5/2009 | Iske et al. | 206/366 |
| 2011/0311950 | A1* | 12/2011 | Preston et al. | 434/21 |

OTHER PUBLICATIONS

Pending U.S. Appl. No. 13/422,620, filed Mar. 16, 2012 and titled "Gun Ports", by Roger Allen Nolte and Adam D. Baird.

U.S. Appl. No. 13/899,448, filed May 21, 2013 titled "Hands-Free Gun-Port Door with Seal" by Groening.

* cited by examiner

LASER DEFENSE GUN PORTS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to gun port assemblies as used in defense of vehicles and buildings, and in particular to gun ports used during training exercises when an attacker may use a laser beam to simulate a ballistic weapon such as an assault rifle by attempting to direct a laser beam through a gun port.

2. Description of the Related Art

Gun ports are well known in the art for both military and non-military applications. A gun port permits discharge of a fire arm through an opening defined by the gun port whenever the gun port is in an open position. The gun port secures the port against passage of a bullet or other unwanted projectile whenever the gun port is in a closed position. Typically gun ports include a door as a closure shield secured on either an interior or exterior surface of a support apparatus such as an exterior wall of an armored vehicle or the exterior wall of a building. The door is often actuated by an operator of the gun port standing or sitting next to it while inside the armored vehicle or building. Examples of the prior art in gun ports are provided by U.S. Pat. Nos. 4,771,672; 4,771,673; and 6,425,311. In all three of these examples, the door consists of a single plate of metal. The first example discloses a door (or "closure plate") that is a single plate slid upward to open, and downward to close. The second example discloses a door (or "closure") that is a single plate that is pivoted inward and downward to open, and upward and outward to close. The third example discloses a door (or "closure shield") that is a single plate mounted on the outside of an exterior wall and that rotates parallel to the wall in a first rotational direction to open, and in the reverse direction to close.

The prior art does not disclose gun ports designed to prevent passage of a laser beam coming from outside. What is needed is a gun port that can block passage of a laser beam from coming through the gun port at a user of a gun being aimed or fired from the gun port, or being inserted or removed in or out of a shoot port part of a gun port. It is also needed that such a gun port and/or its shoot port be constructed as a subassembly that can be easily installed, replaced, and/or removed.

BRIEF SUMMARY OF THE INVENTION

The invention is pointed out with particularity in the appended claims. However, some aspects of the invention are summarized in the following descriptions of some implementation examples and aspects. See the first paragraph below under the section titled "Detailed Description of the Invention" for some important word and term definitions applicable to this disclosure and the claims.

Exemplary implementations of the invention include gun port assemblies fitted to a wall of a building or vehicle. Each of these implementations of the shoot port part of a gun port assembly includes an expandable aperture that accommodates penetration from within the building or vehicle by a gun barrel with or without the barrel having irregularly shaped attachments. The gun port assemblies with special shoot ports can provide protection against laser pointers used in training exercises, where lasers are used outside the gun ports by attackers attacking those protected behind the gun port assemblies. Each implementation of a gun port assembly can accommodate guns of different sizes and shapes. The gun port assemblies can be configured to include exchangeable shoot port cartridges or subassemblies that can readily replace regular non-expandable apertures otherwise used in defense against real ballistic weapons and explosives. Each expandable aperture expands and contracts as necessary to fit sizes and shapes of a gun barrel portion inserted through it. Of special importance for this accommodation is accommodation of a laser emitter and/or sensor module attached to the barrel near the firing end of the gun. A window for sighting the gun can also be provided above the aperture.

Some exemplary implementations of the invention each include a gun port assembly having a shoot port or aperture through which a gun barrel can be inserted and removed without allowing light in a laser beam to get through too. In these implementations, the aperture comprises multiple fingers, leaves, or bristles extending inward from a shoot port frame toward a central region of the aperture and that move or deflect outward from the central region as they follow contours of a gun barrel when the firing end of the gun barrel is inserted into the aperture or removed from the aperture. The deflection of the fingers, leaves, or bristles may be by way of hinges supporting the fingers or leaves at the shoot port frame, or the individual fingers, leaves, or bristles may be flexible enough to bend out of the way. Deflection of the fingers, leaves, or bristles outward constitutes an opening of the port, whereas deflection or relaxation inward constitutes a closing of the port. In some of these implementations, the fingers, leaves, or bristles deflect far enough to also permit passage of one or more ancillary devices attached to the gun barrel, such as a laser detection and/or emission device used in training exercises where laser beams are used to simulate trajectories of ballistic projectiles such as bullets. Depending upon the implementation, the fingers, leaves, or bristles can be thin elements with sizes and shapes suitable to a particular implementation, or they can be strait or tapered wires or bristles which may be generally round in their cross sections. The fingers, leaves, or bristles are substantially arranged to obstruct the area bounded by the shoot port frame, and may form multiple aperture layers each layer configured generally co-parallel with the other layers and parallel to a plane defined by a front surface of the shoot port frame. In some implementations, a clear aperture hole having a diameter at least approximately equal to that of a gun barrel may exist at the center of the aperture and its shoot port frame, and this hole may exist in fewer than all of multiple layers of fingers. Gun port assemblies of the current invention can include a sighting window for aiming a gun that is inserted into the shoot port portion. The sighting window can be equipped with one or more optical filters for protection against lasers. The fingers, leaves, or bristles of an aperture can be opaque to light or at least not specularly transparent to the lasers to be used with the gun port assemblies. The fingers, leaves, or bristles can be made of metal, plastic, rubber, or other solid materials. A shoot port frame, along with its aperture fingers, leaves, or bristles, can be constructed as an interchangeable cartridge to enable apertures and their shoot port frames of other configurations to be swapped in and out of use at a gun port assembly. When inserting or removing the firing end of a gun barrel, by pushing or pulling respectively, through a gun port having a shoot port frame and fingers, leaves, or bristles of the current invention, the actions of pushing or pulling the gun provide the forces necessary to open or close the aperture through movement of the fingers.

Objects and Advantages of the Invention

Objects and advantages of the present invention are numerous. One object and advantage is a gun port assembly that can block laser light from passing through a gun port, especially from lasers pointed at the gun port from outside the wall of a building or vehicle to which the gun port is installed. This blockage is accomplished by gun port configurations that permit insertion and removal of the firing end of a gun through a shoot port without opening more than is at least approximately necessary to pass just the cross-sectional area of the gun and any of its attached accessories. Other objects and advantages are gun port assemblies designed intentionally to provide for interchangeable shoot ports or apertures, replaceable windows, interchange of guns of various kinds, interchange of various attachments made to the barrel of a gun, and complete closure of the shoot port or aperture when guns are not being used through them.

The various features and further advantages of the present invention and its preferred embodiments will become apparent to ones skilled in the art upon examination of the accompanying drawings and the following detailed description of exemplary implementations. It is intended that any additional advantages be incorporated herein. The contents of the following description and of the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention of gun port assemblies may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. Within these drawings.

DETAILED DESCRIPTION OF THE INVENTION

Figure 1:
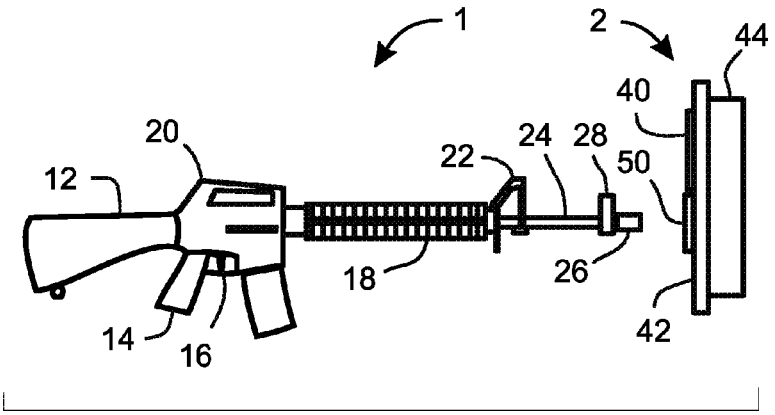
FIG. 1 shows a side view of a gun and a gun port assembly suitable for mounting in a wall of a building or vehicle.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims. However, within this disclosure and the claims which follow, the following terms are given the following particular meanings: 1) the word "gun" is defined to mean a weapon (e.g. a rifle or pistol) that can normally be supported and operated by a human, or to mean at least an approximate replica of such a weapon; 2) the word "aperture" used as a noun, regardless of any adjectives modifying it, is defined to mean a fixture within a wall through which the barrel of a gun can be inserted to enable its user within the building or vehicle to aim or fire the gun at targets outside the building or vehicle; 3) the term "shoot port" is defined to be a synonym of "aperture"; 4) the terms "gun port" and "gun port assembly" are defined to be synonyms of one another and are defined to mean an assembly that includes a shoot port; and 5) the words "finger", "leaf", and "bristle" are defined synonymously, although they may have different shapes, to mean movable or otherwise deflectable elements which move to open or close an aperture. Within these drawings, callouts using like reference numerals refer to like elements in the several figures (also called views) where doing so won't add confusion, and callouts with primes or double primes are to objects that may be similar but have some difference(s) from those objects identified by the un-primed call-outs.

FIG. 1 shows a side view of a gun 1 (or rifle) and an example implementation of a gun port assembly 2 of the current invention. The gun port assembly 2 is one suitable for mounting into a hole in a wall of a building or vehicle where the wall separates an inside space from an outside space. The gun 1 is shown to be in the inside space, which is to say on the inside of the gun port assembly 2. The outside would be to the right of the gun port assembly 2 in this view. The gun 1 shown here has a stock 12, a handle 14, a trigger 16, a forward handgrip 18, a rear sight 20, a front sight 22, a barrel 24, a flash suppressor 26, and an optional ancillary attachment 28 such as a laser sensor and/or emitter. The gun port assembly 2 is shown to include a window 40, a front portion 42 of the frame of a gun port assembly, a rear portion 44 of the frame of the gun port assembly, and an aperture or shoot port 50.

Figure 2:
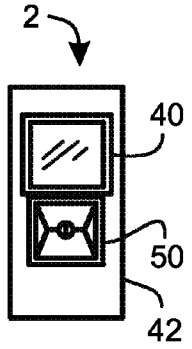
FIG. 2 shows a frontal view of the gun port assembly shown in FIG. 1 and equipped with an aperture or shoot port having a rectangular shoot port frame.

FIG. 2 shows a frontal view of the gun port assembly 2 shown in FIG. 1 and equipped with the aperture or shoot port 50 having a rectangular outer shape.

Figure 3:
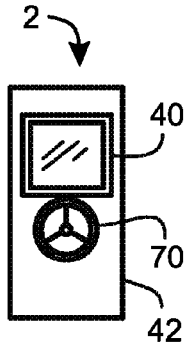
FIG. 3 shows a frontal view of the gun port assembly shown in FIG. 1 and equipped with an aperture or shoot port having a circular shoot port frame.

FIG. 3 shows a frontal view of the gun port assembly 2 shown in FIG. 1 and equipped with an aperture or shoot port 70 having a circular outer shape.

Figure 4:
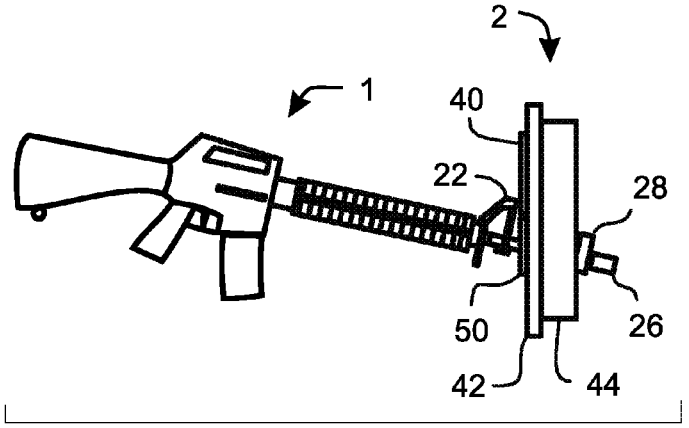
FIG. 4 shows a side view of the gun and gun port assembly shown in FIG. 1 but with the gun barrel inserted through the aperture or shoot port and aimed slightly downward.

FIG. 4 shows a side view of the gun 1 and gun port assembly 2 shown in FIG. 1 but with the muzzle end of the gun barrel 24 having been pushed or otherwise inserted through the shoot port 50 and aimed slightly downward.

Figure 5:
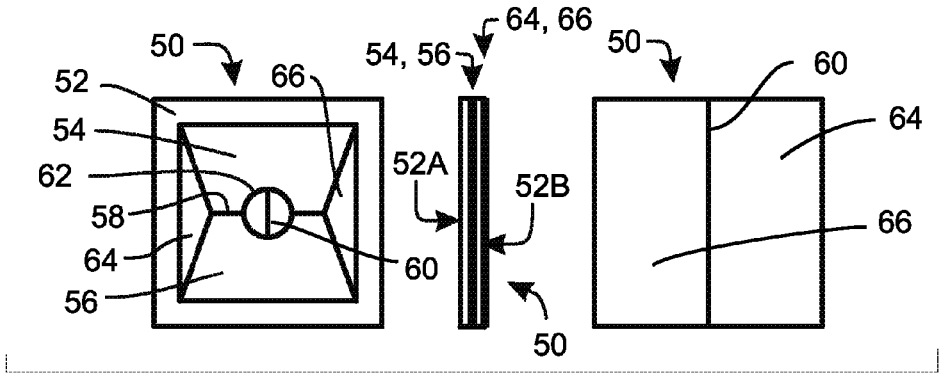
FIG. 5 shows front, side, and rear views of an aperture or shoot port having a rectangular shoot port frame holding four generally rectangular fingers or leaves wherein the front or nearer two leaves form a first central hole.

FIG. 5 shows three views of the aperture or shoot port 50 shown in FIGS. 1 and 2. On the left in this figure is a front view of the shoot port 50 (or aperture 50) as viewed from the inside or shooter's side; on the right is a rear view or view from the outside; and in the middle is a side view. The shoot port 50 comprises a shoot port frame 52 holding four generally rectangular fingers or leaves 54, 56, 64, and 66. Leaves 54 and 56 form a central first hole 62 where they otherwise have horizontal edges 58 substantially touching one another (or where they are at least closely adjacent to one another). Leaves 54 and 56 are in the front and are generally each of trapezoidal shape not counting the cutouts for the hole 62. Leaves 64 and 66 are rectangular, are in the rear, and do not form a central second hole where they have vertical edges 60 substantially touching one another (or where they are at least closely adjacent to one another). In the side view, the shoot port frame 52 is shown in this implementation to have front and rear frame parts 52A and 52B respectively. The frame parts 52A and 52B support the leaves 54 and 56 by sandwiching only an upper region of leaf 54 at the top of the shoot port frame 52, and only a lower region of leaf 56 at the bottom of the shoot port frame 52. This allows a lower portion of leaf 54 to be deflected toward the outside and relative to support near the top of the shoot port frame 52, and an upper portion of leaf 56 to be deflected toward the outside and relative to support near the bottom of the shoot port frame 52. On the other hand, leaves 64 and 66 are fastened only to the left and right sides of the rear frame part 52B. Relative to the perspective of the view on the right hand side, the leaf 66 is fastened at the left near its left edge to the rear frame part 52B, and the leaf 64 is fastened at the right near its right edge to the rear frame part 52B. This allows leaf 66 to be deflected toward the outside and relative to its support at the right of the shoot port frame 52 (as viewed from the inside), and leaf 64 to be deflected toward the outside and relative to its support at the left of the shoot port frame 52 (as viewed from the inside).

Figure 6:
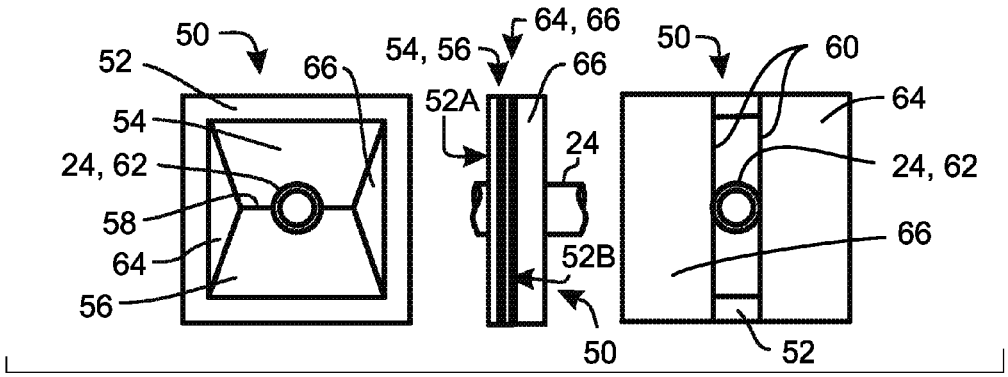
FIG. 6 shows the aperture or shoot port of FIG. 5 but having a portion of a gun barrel extended through the aperture and the first central hole.

FIG. 6 shows the same three views of the shoot port 50 of FIG. 5 but having a portion of a gun barrel 24 extended through its shoot port aperture. In this implementation, the inside leaves 54 and 56 can return to positions they had before the gun was inserted into the shoot port 50, as the hole 63 is large enough to accommodate the gun barrel 24. But since there is no equivalent circular hole between the leaves 64 and 66, those leaves have deflected outward and out of the way of the gun barrel 24. Laser light aimed at the aperture from outside the shoot port 50 may enter through the space between edges 60 of the outer two leaves 64 and 66, but that light will be blocked by the inside leaves 54 and 56.

Figure 7:
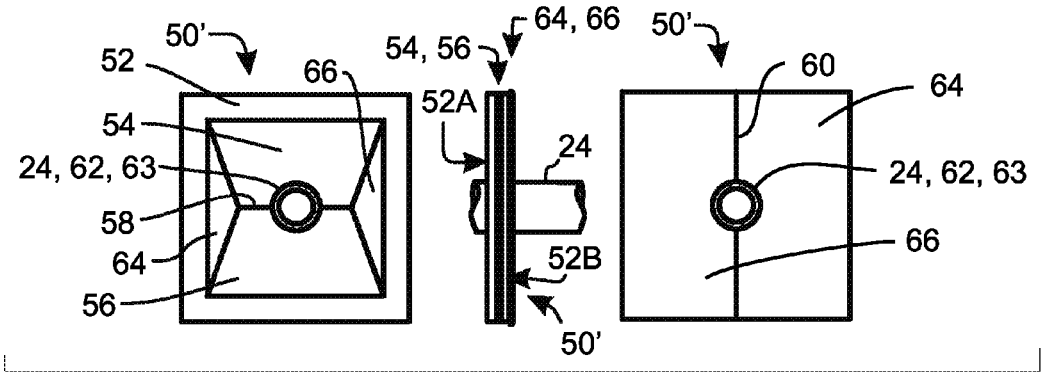
FIG. 7 shows three views of an aperture or shoot port having a rectangular shoot port frame similar to that shown in FIG. 6, but wherein the rear or more distant two fingers or leaves form a second central hole aligned concentrically with the first central hole.

FIG. 7 shows three similar views of a slightly modified version of an aperture or shoot port 50', similar to shoot port 50 shown in FIG. 6. The modification is that the rear or more distant two fingers or leaves 64 and 66 form a second hole 63 which is aligned to be coaxial with the first hole 62. Thus in this implementation the leaves 64 and 66 form a central second hole 63 where they have vertical edges 60 substantially touching one another (or where they are at least closely adjacent to one another). It is shown in the rear view (on the right of this figure) that all four leaves 54, 56, 64, and 66 can take their undisturbed positions and shapes while a gun barrel alone remains at rest in the shoot port 50, thus blocking entry of any laser light directed at the shoot port 50 from outside.

Figure 8:
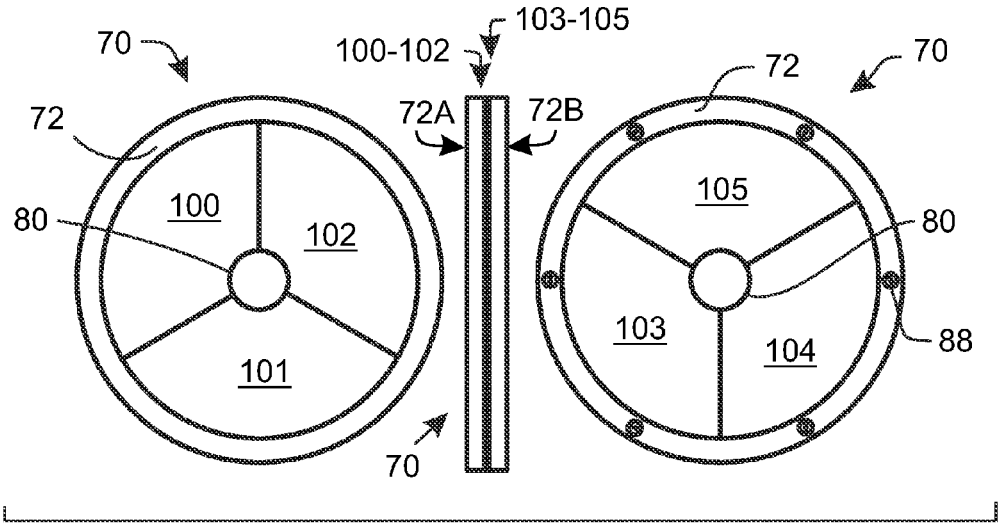
FIG. 8 shows front, side, and rear views of an aperture or shoot port having a circular shoot port frame and that is of annular shape with three fingers or leaves in the front and three in the rear.

FIG. 8 shows front, side, and rear views of an aperture or shoot port 70 having a circular shoot port frame 72 made up of front and rear parts 72A and 72B respectively. The aperture or shoot port 70 has an annular shape with three fingers or leaves 100-102 in the front and three fingers or leaves 103-105 in the rear. In this implementation, all six fingers or leaves 100-105 are held at their outer perimeters by being sandwiched between the front part 72A and rear part 72B of a shoot port frame 72. Fasteners 88 hold the front part 72A and rear part 72B of the shoot port frame 72 together. Given fingers or leaves 100-105 that are flexible, the central opening or hole 80 can open up to allow a gun barrel and its attachments to pass into and through that opening.

Figure 9:
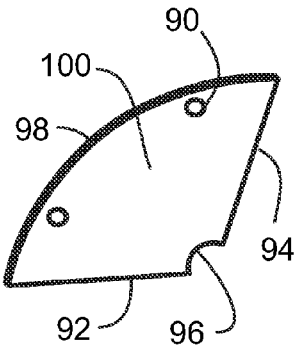
FIG. 9 shows a perspective view of one of the fingers or leaves from FIG. 8 and reveals its substantially annular segment shape.

FIG. 9 shows a perspective view of finger or leaf 100 shown in FIG. 8 and reveals its substantially annular segment shape. FIG. 9 also shows that finger or leaf 100 is thin relative to its larger dimensions, and that it comprises two opposite and plane-parallel surfaces bounded by a first straight edge 92, a second straight edge 94, and two circular arc shaped edges 96 and 98. Edge 98 is larger than edge 96. Edges 92 and 94 run radially outward from the hole 80 (shown in FIG. 8). Finger or leaf 100 is shown having two holes 90 used as clearance for the fasteners 88. Fingers or leaves 100-105 shown in FIG. 8 are all shaped alike.

Figure 10:
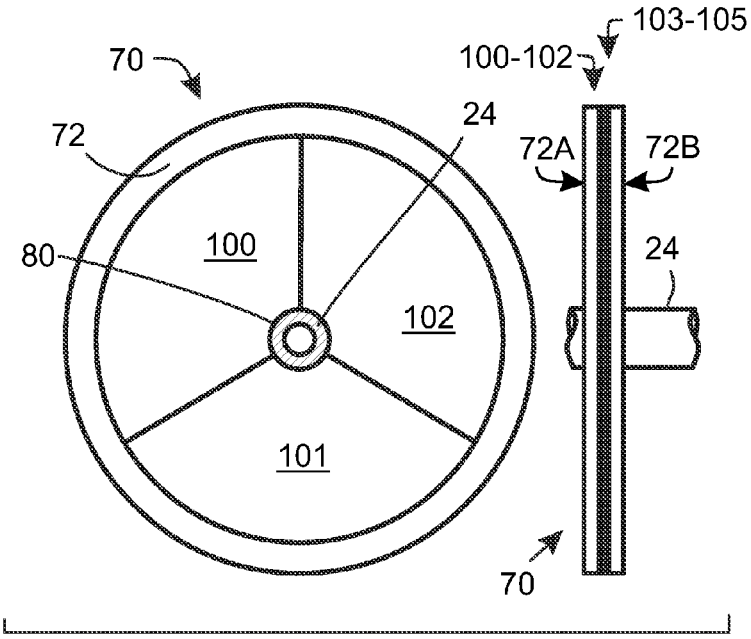
FIG. 10 shows front and side views of the aperture or shoot port of FIG. 8 but showing a gun barrel penetrating through the central hole of the annular shaped aperture.

FIG. 10 shows front and side views of the aperture or shoot port 70 shown in FIG. 8, but these views include showing a portion of gun barrel 24 penetrating through the hole 80 that is formed by the inner edges 96 of all the fingers or leaves 100-105.

Figure 11:
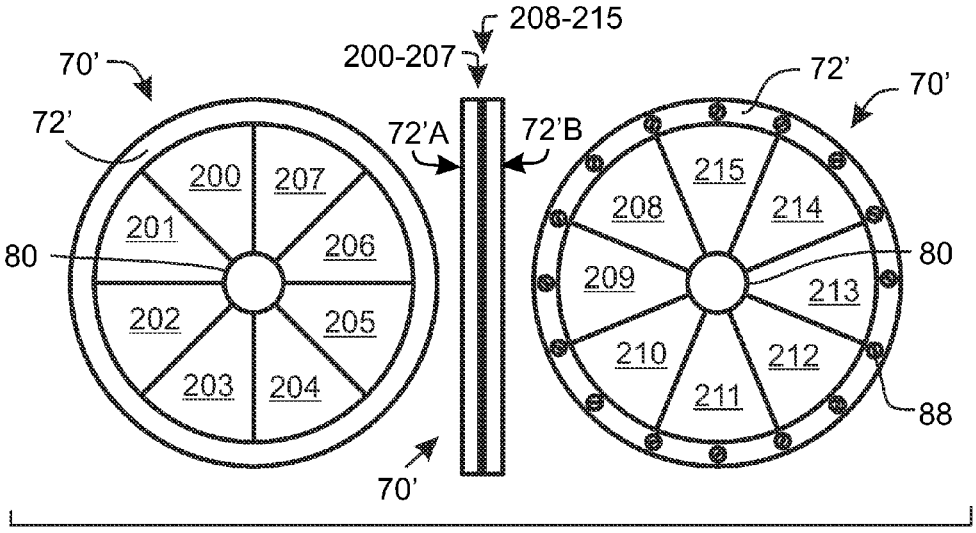
FIG. 11 shows an aperture or shoot port having a circular shoot port frame and having an annular shape with eight fingers or leaves in the front and another eight in the rear.
Figure 12:
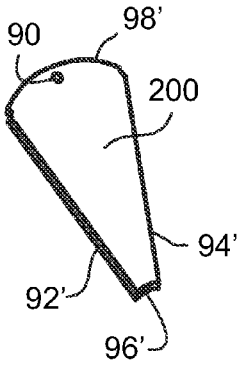
FIG. 12 shows one of the fingers or leaves from FIG. 11 and reveals its substantially annular segment shape.
Figure 13:
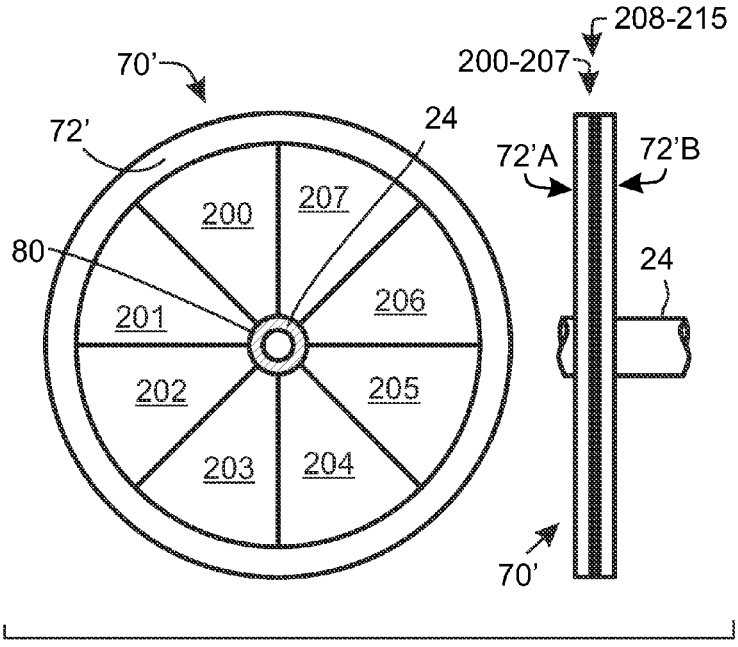
FIG. 13 shows the shoot port frame and aperture of FIG. 11 but showing a gun barrel penetrating through the central hole in the aperture.

FIGS. 11, 12, and 13 show views of another aperture or shoot port 70' (with shoot port frame 72' having front and rear parts 72'A and 72'B respectively) and a detail of one of its fingers or leaves 200. These views are all similar to those in FIGS. 8, 9, and 10; however the number of fingers or leaves has been increased to eight fingers or leaves 200-207 in the front, and eight fingers of leaves 208-215 in the rear. Thus the fingers 200-215 are each narrower than those in FIGS. 8-10. In FIG. 12, the edges of finger or leaf 100 are 92', 94', 96', and 98'. Also in FIG. 12, only a single leaf mounting hole 90 is shown, and small notches are removed from the corners to either side of the location of the hole 90 for providing clearance to fasteners 88 used to hold immediately adjacent leaves that are either in front or behind leaf 100. As before, all of the fingers or leaves 200-215 are similar in shape and features being substantially shaped as annular segments. An advantage of aperture or port frame 70' over aperture or port frame 70 is that individual fingers or leaves 200-215 don't get stressed as much to allow insertion of a gun barrel 24 and attachments like attachment 28 shown in FIGS. 1 and 4.

Figure 14:
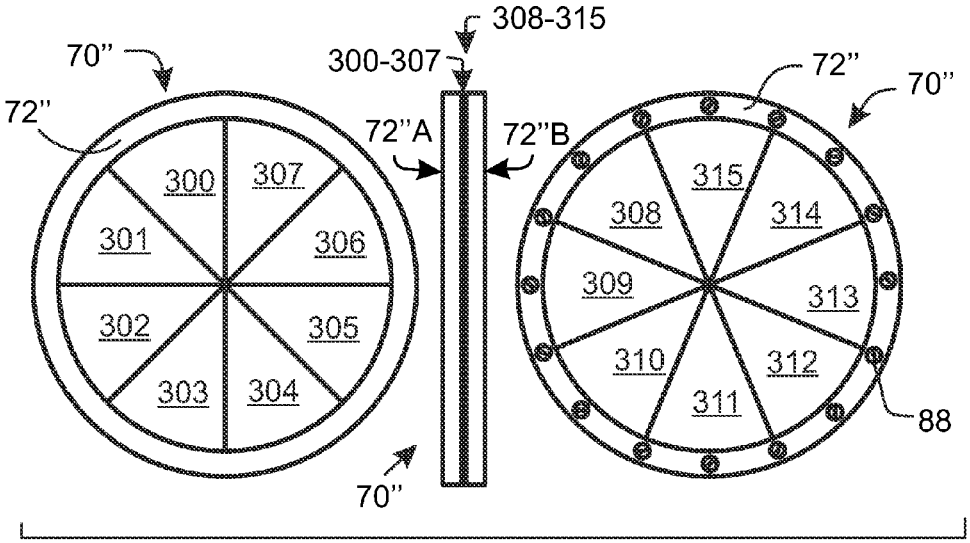
FIG. 14 shows an aperture having a circular shoot port frame and having disc shape with three fingers or leaves in the front and three in the rear.
Figure 15:
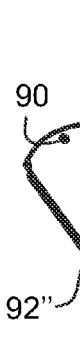
FIG. 15 shows one of the fingers or leaves from FIG. 14 and reveals its substantially segment shape.
Figure 16:
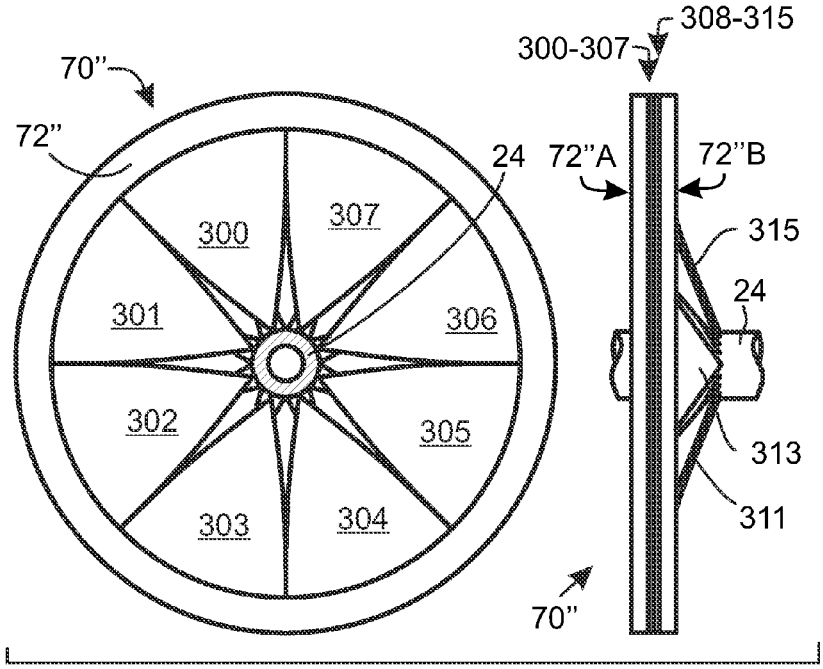
FIG. 16 shows the aperture of FIG. 14 but showing a gun barrel penetrating through the central hole in the aperture.

FIGS. 14, 15, and 16 show views of yet another aperture or shoot port 70" (with shoot port frame 72" having front and rear parts 72"A and 72"B respectively) and a detail of one of its fingers or leaves 300. These views are all similar to those in FIGS. 11, 12, and 13. The number of fingers or leaves has not changed, but the fingers or leaves are numbered 300-315 because they differ from fingers or leaves 200-215 of the previous three figures; the difference is that these fingers or leaves 300-315 are segment shaped rather than annular segment shaped. Each leaf has only three edges rather than four: two radial edges 92" and 94" which form a tip where they intersect one another, and an arc shaped edge 98". FIG. 16 shows how in this implementation, a gun barrel penetrating through the aperture moves the tips formed by edges 92" and 94" out of the way of the barrel 24. FIG. 16 also shows in the front view (on the left) that fingers or leaves 308-315 in the rear block openings caused between adjacent fingers or leaves 300-307 in the front, openings caused by the barrel 24. In like manner, openings caused between adjacent fingers or leaves 308-315 in the rear are blocked by the fingers or leaves 300-307 in the front.

Figure 17:
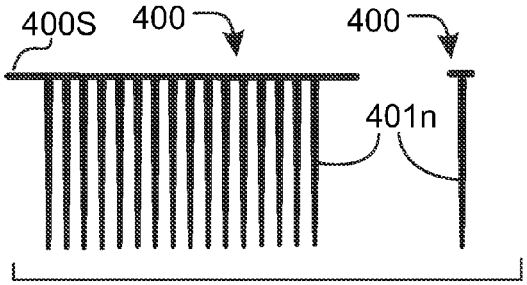
FIG. 17 shows a side view on the left and an end view on the right of a series of wire-like or bristle-like fingers bound to a backing strip.
Figure 19:
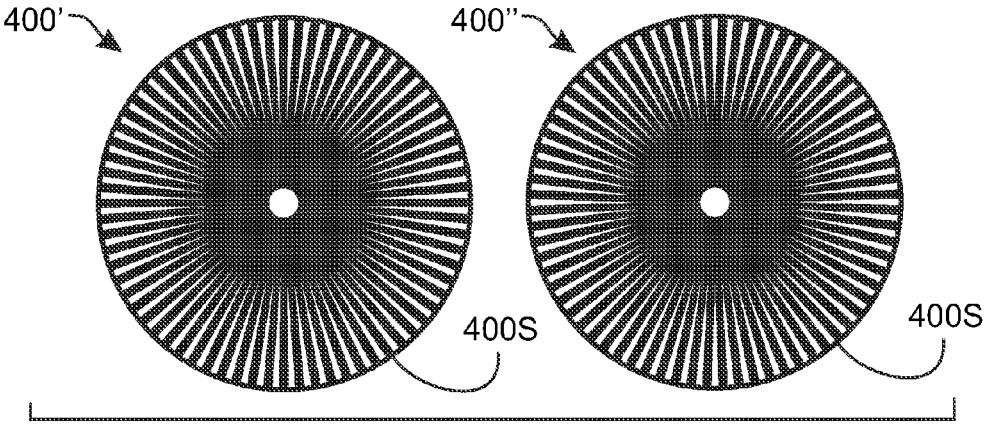
FIG. 19 shows two longer strips like the one shown in FIG. 17 but each wrapped with the backing strip completing a circle and leaving a central hole, wherein one is rotated slightly relative to the other.
Figure 20:
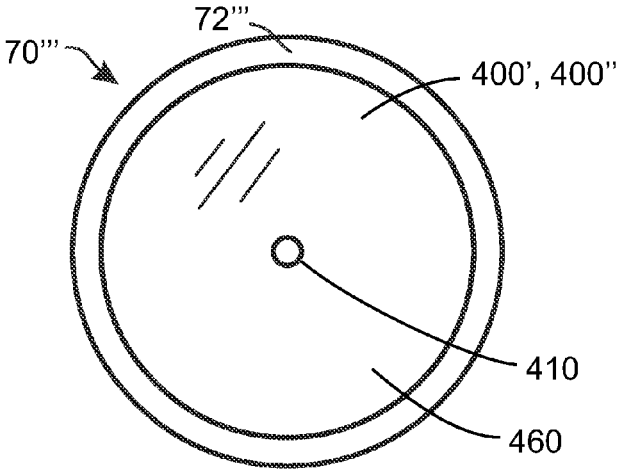
FIG. 20 shows the two discs of fingers aligned one behind the other, wherein the slight rotation one has relative to the other produces a disc filled with fingers and leaving no gaps for light to penetrate from back to front.

FIG. 17 shows a side view on the left and an end view on the right of a series 400 of wire-like or bristle-like fingers 401*n* bound to a backing strip 400S. The bristle-like fingers 401*n* are substantially identical to one-another and are lined up next to one-another in a common plane. The space between them is less than their thickness as measured in that plane. A similar strip with more fingers than shown, and therefore of greater length, can be wound with the backing strip 400S completing a full circle (as shown in FIG. 19 on either the left or the right), or even wrapped many times in helical fashion to form an approximate cylinder. Depending upon the diameter of the circle or the cylinder, and as viewed perpendicular to the plane of the circle, or as viewed along the axis of the cylinder, such windings may or may not form a circular hole in the center. Windings of these types can be used as shoot ports each with their backing strip 400S held in a frame (as shown in FIG. 20). Furthermore multiple windings can be stacked coaxially.

Figure 18:
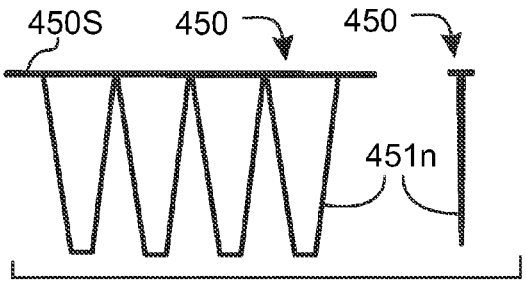
FIG. 18 shows a side view on the left and an end view on the right of a series of narrow wafer-like fingers bound to a backing strip.

FIG. 18 shows a side view on the left and an end view on the right of a series 450 of narrow wafer-like fingers 451*n* bound to a backing strip 450. A similar strip with more fingers than shown, and therefore of greater length, can be wound with the backing strip 450S completing a full circle (as begun in the view of FIG. 21), or even wrapped many times in helical fashion to form an approximate cylinder. Depending upon the diameter of the circle or the cylinder, and as viewed perpendicular to the plane of the circle, or as viewed along the axis of the cylinder, such windings may or may not form a circular hole in the center. Windings of these types can be used as shoot ports each with their backing strip 450S held in a frame (as shown in FIG. 20). Furthermore multiple windings can be stacked coaxially. Note that the ends or tips (shown at the bottom) of the fingers 451*n* are not pointed but are flat or curved. Other implementations can use fingers similar to fingers 451*n* but with pointed ends rather than flat or curved ends.

FIG. 19 shows two longer strips 400' and 400" like the one 400 shown in FIG. 17 but each wrapped with the backing strip completing a circle and leaving a central hole, wherein one is rotated slightly relative to the other so that when stacked one behind the other, the spaces between adjacent fingers of one will be blocked by the fingers of the other (as shown in FIG. 20).

FIG. 20 shows a shoot port 70'" with its frame 72'" containing the two discs of fingers 400 and 400" aligned coaxially one behind the other, wherein the slight rotation one has relative to the other produces the appearance of a disc 460 filled with fingers and leaving no gaps for light to penetrate through the disc except at the center if a hole 410 remains. The view shown can also represent a shoot port made with one or more strips similar to and longer than strips 400 or 450 each wrapped around in a single circle and possibly more than one stacked axially, or each helically wound multiple turns.

Figure 21:
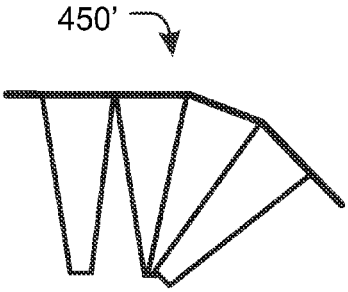
FIG. 21 shows that the strip of fingers shown in FIG. 18 can also be wrapped with its backing strip to form a complete circle (although only a portion of the wrap is shown here).

FIG. 21 shows that the strip of fingers 450 shown in FIG. 18 can be wrapped with its backing strip to form a complete circle (although only a portion of the wrap is shown here, and the callout 450' indicates that the strip is no longer straight).

Figure 22:
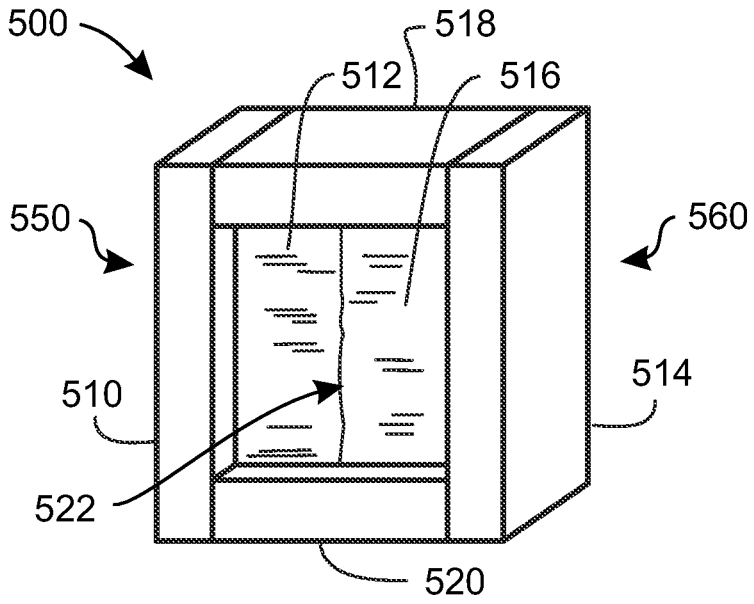
FIG. 22 shows a perspective view of an aperture or shoot port made with two opposing brushes.

FIG. 22 shows a perspective view of an aperture or shoot port 500 made with two opposing brushes 550 and 560 complete with left, right, top and bottom framing members 510, 514, 518, and 520 respectively. The two brushes 550 and 560 each include a respective set of bristles 512 and 516, where each bristle is horizontal in this view, and where all the tips of each brush 550 and 560 define an plane of approximate delineation 522 where the two sets of bristles 512 and 516 touch one another. These two sets of bristles 512 and 516 are pressed against one another to form this common plane of approximate delineation 522 between the two sets of bristles 512 and 516. The location and orientation of this plane of approximate delineation 522 is partly revealed within this view by an uneven and vertical line between the two sets of bristles 512 and 516. In this implementation, the plane of approximate delineation 522 is vertical, but the whole assembly 500 could be easily rotated 90 degrees to make the plane of approximate delineation 522 horizontal. If a gun 24 is inserted between, or removed from between, the two opposing brushes, bristles of the bristle sets 512 and 516 that contact the gun 24 would move out of the way of the gun 24 but leave no gaps for light to pass between the bristle sets 512 and 516 all the way from outside to inside the shoot port 500.

Figure 23:
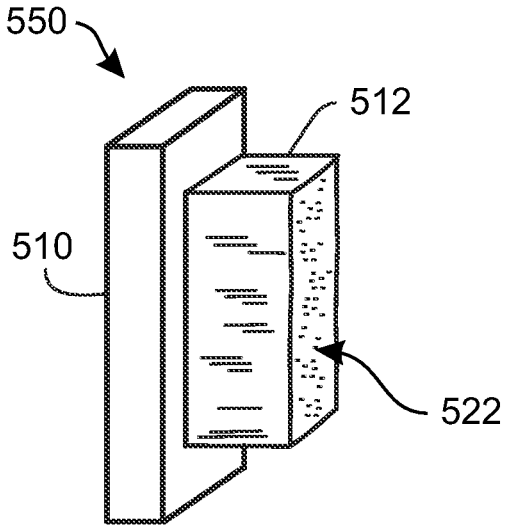
FIG. 23 shows a perspective view of the left brush shown also in FIG. 22.

FIG. 23 shows a perspective view of the left brush 550 visible also in FIG. 22. This left brush includes the left side 510 of the frame and a rectangular block of bristles 512 with all the bristles approximately parallel to one another and all attached to at their left ends to an inner-facing surface of the left side 510 of the frame. The bristles are packed tightly enough together so that they can block light from passing all the way through the block of bristles 512. One can easily imagine that this configuration of a "brush" is similar to that of a common shoe brush or even the head of some push brooms. The right brush 560 (see FIG. 22) is identical to the left brush 550, but having bristles 516 attached to an inner facing surface of the right side 514 of the frame. By "inner facing" is meant a facing the plane of approximate delineation 522. The plane of approximate delineation 522 described with FIG. 22 is approximately coincident with a plane defined by the tips of the bristles 512 (and similarly by the tips of bristles 516). The tips of the bristles in the group of bristles 516 is shown here to be located on the right-most side of the view and pointed to by the callout 522. The bristles can be made of metal, plastic, rubber, or other materials that can be provided as elongated cylinders of relatively small thickness compared to their lengths.

Embodiments of the present invention include methods of using gun ports or their apertures, both of the present invention. One such method comprises steps of: a) pushing a gun barrel, with any objects attached to the barrel, against fingers of an aperture to cause the aperture to open outward substantially from a center that coincides with the axis of the gun barrel, and b) thereafter pulling the gun barrel back out of the aperture to cause the fingers to close inward to at least approximately their closed positions. Any of the following steps can also be included: c) installing a gun port through a hole in a wall of a building or vehicle, d) installing a gun port cartridge containing an aperture, e) exchanging gun port cartridges one for another within a gun port, and f) pivoting a gun that is positioned with its barrel penetrating an aperture so as to find or track locations of an intended target, g) firing a gun while its barrel extends through the gun port, h) interchanging one gun with another gun, i) replacing a viewing window in a gun port, j) replacing a gun port with another gun port, and k) closing a wall up after removing a gun port.

Although specific embodiments of the invention have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention. It is to be understood that the above description has been made in an illustrative fashion, and not a restrictive one. For example, the numerous shoot port configurations 50, 50', 70, 70', 70", 70'", and 500 have been illustrated as either in a rectangular frame or a circular frame, and one skilled in the art can readily envisions these as easily exchangeable cartridges for use with a gun port assembly as shown in FIGS. 1-4. One skilled in the art can also readily understand how to include additional features to these shoot ports to make them simply and conveniently interface or couple with a gun port frame. Combinations of the above embodiments, and other embodiments not specifically described herein will be apparent to those of skill in the art upon reviewing the above description. For example, implementations that include different numbers of fingers, leaves, or bristles than those illustrated and described and intended to be included within the scope of the invention. The scope of various embodiments of the invention includes any other applications in which the above structures and methods are used.

I claim:

1. A gun port assembly comprising:

a. a shoot port cartridge comprising an aperture between two opposite sides of the cartridge;

b. a gun comprising a barrel extended through the aperture, wherein a muzzle end of the barrel is located on a first of the two opposite sides, and the end of the barrel opposite the muzzle end is located on a second of the two opposite sides;

c. one or more laser detection and/or emission accessories attached to the gun barrel on the first of the two opposite sides; and d. an aperture frame supporting multiple fingers, leaves, or bristles that each extend substantially radially inward from the frame toward a central region of the aperture;

wherein the fingers, leaves, or bristles deflect to accept insertion of the gun barrel and its one or more laser detection and/or emission accessories into the aperture; and wherein the fingers, leaves, or bristles are configured to eliminate gaps that could allow laser beam light from directly penetrating the aperture.

2. The gun port assembly of claim 1, wherein the fingers, leaves, or bristles are tapered to narrow as their extension progresses toward the central region of the aperture.

3. The gun port assembly of claim 1, wherein the one or more laser detection and/or emission accessories attached to the gun barrel remain attached to the gun barrel whenever the gun barrel is inserted through the aperture or removed from the aperture.

4. The gun port assembly of claim 1, wherein the fingers, leaves, or bristles deflect far enough to permit passage of the one or more laser detection and/or emission accessories attached to the gun barrel, wherein the one or more laser detection and/or emission accessories attached to the gun barrel may extend sideways from the gun barrel a distance equivalent to more than one diameter of the gun barrel.

5. The gun port assembly of claim 1, wherein the aperture is configured to open or close as a gun barrel is inserted into the aperture or withdrawn from the aperture, respectively.

6. The gun port assembly of claim 1, wherein the fingers, leaves, or bristles are hinged from the frame.

7. The gun port assembly of claim 1, wherein the fingers, leaves, or bristles bend as necessary to track contours of the gun barrel and one or more laser detection and/or emission accessories attached to the gun barrel.

8. The gun port assembly of claim 1, wherein each finger comprises two generally co-parallel surfaces bounded by edges of the finger.

9. The gun port assembly of claim 1, wherein each finger or bristle is circularly symmetric in cross-sections perpendicular to its own axis of elongation.

10. The gun port assembly of claim 1, wherein at least some of the fingers, leaves, or bristles can remain undeflected for at least some positions of the gun barrel.

11. The gun port assembly of claim 1, wherein the fingers, leaves, or bristles are made of a plastic material.

12. The gun port assembly of claim 1, wherein not all the fingers, leaves, or bristles are anchored to the frame in a single plane.

13. The gun port assembly of claim 1, further comprising multiple aperture layers each configured generally co-parallel to a plane defined by a front surface of the frame.

14. The gun port assembly of claim 1, wherein the fingers, leaves, or bristles are not specularly transparent.

15. The gun port assembly of claim 1, wherein the gun barrel is that of a firearm.

16. The gun port assembly of claim 1, wherein the frame is configured to be interchangeable with at least another frame.

17. The gun port assembly of claim 1, further comprising a window through which a person shooting the gun can track a moving target.

18. A gun port comprising:

a. a cartridge comprising an aperture; and b. a gun barrel extended through the aperture, wherein one or more laser detection and/or emission accessories is/are attached to the gun barrel;

wherein the cartridge comprises a removable frame supporting multiple fingers, leaves, or bristles that each extend substantially radially inward from the frame toward a central region of the aperture;

wherein the fingers, leaves, or bristles are tapered to narrow as their extension progresses toward the central region of the aperture;

wherein the fingers, leaves, or bristles deflect to accept insertion of the gun barrel and its one or more laser detection and/or emission accessories into the aperture;

wherein the one or more laser detection and/or emission accessories attached to the gun barrel remain attached to the gun barrel whenever the gun barrel is inserted through the aperture or removed from the aperture; and wherein the fingers, leaves, or bristles are configured to eliminate gaps that could allow laser beam light from directly penetrating the aperture even as the gun barrel and its attachments are inserted or removed from the aperture.

19. The gun port of claim 18, wherein the aperture fingers, leaves, or bristles are arrayed circumferentially about an axis along which the gun barrel penetrates the aperture.

20. A method of using a gun port comprising the steps of:

a. providing a gun port comprising:

i. a cartridge comprising an aperture; and ii. a gun barrel extended through the aperture, wherein one or more laser detection and/or emission accessories is/are attached to the gun barrel;

wherein the cartridge comprises a removable frame supporting multiple fingers, leaves, or bristles that each extend substantially radially inward from the frame toward a central region of the aperture;

wherein the fingers, leaves, or bristles are tapered to narrow as their extension progresses toward the central region of the aperture;

wherein the fingers, leaves, or bristles deflect to accept insertion of the gun barrel and its one or more laser detection and/or emission accessories into the aperture;

wherein the one or more laser detection and/or emission accessories attached to the gun barrel remain attached to the gun barrel whenever the gun barrel is inserted through the aperture or removed from the aperture; and wherein the fingers, leaves, or bristles are configured to eliminate gaps that could allow laser beam light from directly penetrating the aperture even as the gun barrel and its attachments are inserted or removed from the aperture;

b. withdrawing the gun barrel from the aperture without detaching the accessories from the gun barrel or disassembling the rest of the gun port.

21. A method of using a laser-defense gun port comprising the steps of:

a. providing a gun port comprising an aperture covered over at least partially by flexible fingers, leaves, and/or bristles;

b. exchanging a ballistic-defense gun port with said laser-defense gun port; and c. inserting a portion of a gun barrel, and laser detection and/or emission devices attached to the outside of the gun barrel, through the laser-defense gun port.

* * * * *